United States Patent [19]

Saito

[11] Patent Number: 4,917,596

[45] Date of Patent: Apr. 17, 1990

[54] PULSATING COMBUSTION SYSTEM AND METHOD OF STARTING THE SYSTEM

[75] Inventor: Kazuo Saito, Fujisawa, Japan

[73] Assignee: Kabushiki Kaisha Toshiba, Kawasaki, Japan

[21] Appl. No.: 385,590

[22] Filed: Jul. 27, 1989

[30] Foreign Application Priority Data

Jul. 29, 1988 [JP] Japan ..... 63-188224

[51] Int. Cl.[4] ..... F23C 11/04

[52] U.S. Cl. ..... 431/1; 60/39.77

[58] Field of Search ..... 431/1, 6; 60/247, 39.76, 60/39.77, 39.78, 39.79, 39.8, 249; 122/24

[56] References Cited

U.S. PATENT DOCUMENTS 2,748,753 6/1956 Sarrazin et al. ..... 122/24
3,447,878 6/1969 Haag et al. ..... 431/1
4,639,208 1/1987 Inui et al. ..... 431/1

FOREIGN PATENT DOCUMENTS 0207812 10/1985 Japan ..... 431/1

*Primary Examiner*—Carl D. Price
*Attorney, Agent, or Firm*—Cushman, Darby & Cushman

[57] ABSTRACT

A pulsating combustion system comprising a pair of pulsating combustors of the same structure connected in parallel between an air-intake chamber and an exhaust chamber and having an air-intake pipe and an aerodynamic valve fitted within the air-intake pipe. A separation valve is located in said air-intake chamber, for partitioning the air-intake chamber into a sub-chamber communicating with the air-intake pipe of the first pulsating combustor and a sub-chamber communicating with the air-intake pipe of the second pulsating combustor. In operation, the separation valve partitions the air-intake chamber into two sub-chambers, and the pulsating combustors are operated independently of each other for some time. When the pulsating combustion performed by either pulsating combustor becomes sufficiently stable, the separation valve is gradually opened, thus connecting said pulsating combustors. Thereafter, both combustors continue to perform stable pulsating combustions, perfectly out of phase.

7 Claims, 10 Drawing Sheets

PULSATING COMBUSTION SYSTEM AND METHOD OF STARTING THE SYSTEM

BACKGROUND OF THE INVENTION

1. Field of the Invention

The present invention relates to a pulsating combustion system comprising two parallel-connected pulsating combustors, and also to a method of starting the pulsating combustion system.

2. Description of the Related Art

A pulsating combustor is advantageous over the ordinary burner in various respects, such as thermal efficiency, content of harmful substance in the exhaust gas, and the like.

Most pulsating combustors comprises a combustion chamber having an exhaust port, a fuel passage through which a fuel is supplied into the combustion chamber, an air passage through which air is supplied into the combustion chamber, a tail pipe connected to the exhaust port of the combustion chamber, a flap valve located within the air passage, and an ignitor for igniting the air-fuel mixture in the combustion chamber to start the combustor.

When the mixture gas, i.e., the air-fuel mixture, is ignited, it is explosively combusted. As a result, the pressure within the combustion chamber increases abruptly, automatically closing the flap valve located in the air passage. Simultaneously, the combustion gas is exhausted at high speed through the exhaust port of the combustion chamber. As a result of this gas-exhaustion, a negative pressure is generated within the combustion chamber. Hence, the flap valve opens, allowing both air and fuel to flow into the chamber. When the air and the fuel flow into the chamber, each in a predetermined amount, and are thoroughly mixed, the resultant mixture gas is combusted explosively, ignited by the flame remaining in the combustion chamber. The combustion is repeatedly performed in the combustion chamber. This combustion is an intermittent or pulsative one. The pulsating combustor inevitably makes much noise during operation.

A pulsating combustion system has been invented which is designed to make less noise during operation. This system comprises a pair of pulsating combustors connected in parallel to each other. An aerodynamic valve, whose forward flow efficiency is greater than the backward flow efficiency, is provided within the air passage of either pulsating combustor. The aerodynamic valve cannot prevent the backflow of air completely. In other words, it performs an incomplete backflow prevention. Due to this incomplete backflow prevention, the pressure changes in the combustion chambers of the combustors interfere with each other. As a result of this, the gas intake, combustion-explosion, and gas exhaustion in the first pulsating combustor can be 180° out of phase with those taking place in the second pulsating combustor. Thus, the pressure changes in the combustion chamber of the first combustor are cancelled out by those in the combustion chamber of the second combustor, whereby the pulsating combustion system makes less noise than the conventional pulsating combustor.

To start the pulsating combustion system, the residual gas is purged from the combustion chambers of both pulsating combustors, and then the ignitors of the both pulsating combustors are operated. In this condition, the mixture gas is introduced into the combustion chambers to combusted explosively. This method of ignition cannot ignite the mixture gas in one chamber, with a time lag of a few milliseconds with respect to the ignition in the other combustion chamber. Consequently, the gas intake, combustion-explosion, and gas exhaustion in one combustor cannot be set quickly at 180° out of phase with those taking place in the other combustor. It inevitably takes long until the pulsating combustors come to perform combustion in completely out of phase by 180°, or the pulsating combustors alternately achieve explosions but at two low a frequency. In short, the pulsating combustion system fails to operate as stably as is desired.

SUMMARY OF THE INVENTION

It is the object of the present invention to provided a pulsating combustion system wherein two pulsating combustors can start performing stable combustion alternately within a short period of time, and also to a method of starting the pulsating combustion system.

In the system and the method according to the invention, an air-intake chamber is used, which is connected to the upstream ends of two air passages for supplying air into the combustion chambers of the two pulsating combustors, either air passage containing an aerodynamic valve. A separation valve is located within the air-intake chamber, for selectively partitioning the air-intake chamber into two chambers, one communicating with the air passage connected to the first pulsating combustor, and the other communicating with the air passage of the second pulsating combustor. The system comprises means for opening the separation valve, thereby partitioning the air-intake chamber into two chambers to make the combustors operate independently, and for gradually closing the separation valve, thus releasing the partition in the air-intake chamber, little by little.

Therefore, the mixture gas in the combustion chambers of the respective pulsating combustors is ignited, with the air-intake chamber partitioned by means of the separation valve. In other words, during the starting period of the system, the pulsating combustors effect pulsating combustion independently during the starting period of the system, and start interfering with each other through the aerodynamic valve upon elapse of a predetermined period of time. As a result, the pulsating combustors reliably and quickly start, performing stable combustion alternately.

DETAILED DESCRIPTION OF THE PREFERRED EMBODIMENTS

Figure 1:
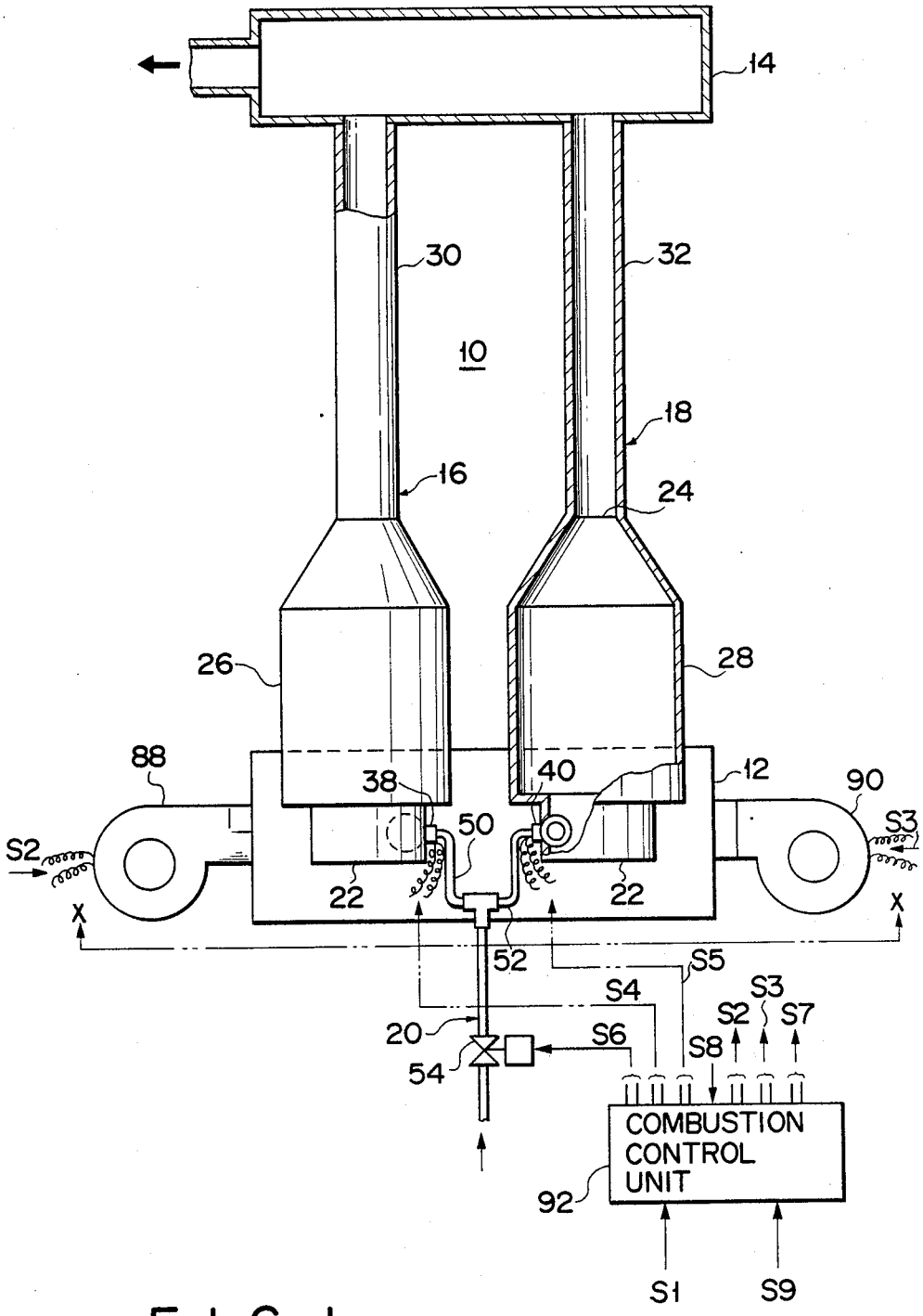
FIG. 1 is a partially sectional, front view showing a pulsating combustion system according to one embodiment of the present invention.
Figure 2:
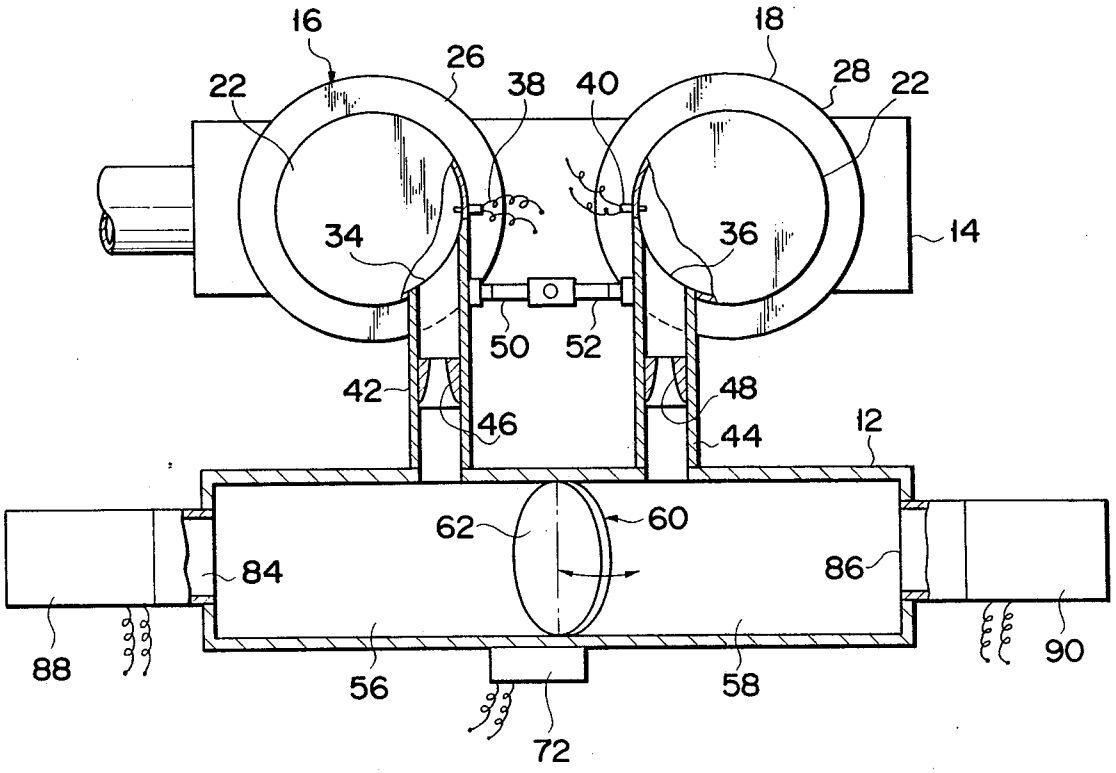
FIG. 2 is a partially cross-sectional, side view, taken along line X—X in FIG. 1.

FIGS. 1 and 2 illustrate a main section 10 of the pulsating combustion system according to the invention, which has two pulsating combustors. As these figures show, the main section 10 comprises a hollow cylindrical air-intake chamber 12, a hollow cylindrical exhaust chamber 14, two pulsating combustors 16 and 18, identical in both size and structure, extending parallel between the air-intake chamber 12 and the exhaust chamber 14, and a fuel-supplying system 20 connected to both pulsating combustors 16 and 18.

The pulsating combustors 16 and 18 have combustion chambers 26 and 28, respectively, each having an exhaust port 24 and a closed bottom 22. The exhaust ports of the chambers 26 and 28 are connected to the exhaust chamber 14 by means of tail pipes 30 and 32, respectively.

As is illustrated in FIG. 2, the combustion chambers 26 and 28 have air-intake ports 34 and 36, respectively, made in those portions of the peripheral walls which are close to the bottoms 22. Ignitors 38 and 40 penetrate the peripheral walls of the chambers 26 and 28 and extend into these chambers, with their spark plugs located within the chambers 26 and 28 and close to the air-intake ports 34 and 36, respectively. Air-intake pipes 42 and 44 are connected at one end to the air-intake ports 34 and 36, and at the other end to the air-intake chamber 12. The pipes 42 and 44 are connected to the combustion chambers 26 and 28, with their axes extending at right angles to the axes of the chambers 26 and 28 but not intersecting therewith.

As is evident from FIG. 2, aerodynamic valves 46 and 48 are fitted within the intermediate portions of the air-intake pipes 42 and 44, respectively. These aerodynamic valves have a forward flow efficiency greater than a backward flow efficiency. More specifically, they have nozzles flaring away from the combustion chambers 26 and 28. Hence, they allow air to flow into the combustion chambers 26 and 28 more easily than into the air-intake chamber 12.

A fuel-injecting port (not shown) is made in that portion of either air-intake pipe which is located between the intermediate portion of the pipe and the air-intake port of the combustion chamber. Fuel-supplying pipes 50 and 52 are connected at one end to the fuel-injecting ports of the pipes 42 and 44, respectively. The fuel-supplying pipes 50 and 52 are connected at the other end to a fuel gas source (not shown) by means of a fuel-supplying valve 54 which is a solenoid valve as is clearly understood from FIG. 1.

As is shown in FIG. 2, a separation valve 60 is provided within the air-intake chamber 12, fixed in the intermediate part thereof. This valve 60 is designed to partition the chamber 12 into two chambers, a chamber 56 connected to the air-intake pipe 42 and a chamber 58 connected to the air-intake pipe 44. As is shown in greater detail in FIG. 3, the separation valve 60 comprises a valve disc 62 and two shafts 64 and 66. The disc 62 has a diameter little less than the inner diameter of the air-intake chamber 12. The shafts 64 and 66 protrude from the periphery of the disc 62 and are symmetrical with each other with respect to the axis of the air-intake chamber 12. The shafts 64 and 66 are rotatably supported by bearings 68 and 70, both set in the inner periphery of the chamber 12. The shaft 66 extends from the air-intake chamber 12 and is connected to a valve drive device 72. The device 72 comprises an electric motor 74, a reduction gear 76 coupled to the output of the motor 74, a worm 78 connected to the output of the reduction gear 76, and a worm gear 80 mounted on the shaft 66 and in mesh with the worm 78. A potentiometer 82 is connected to the valve device 72, for detecting the angle of rotation of the valve disc 62.

As is evident from FIG. 2, the air-intake chamber 12 has two air inlet ports 84 and 86, each at one end of the chamber 12. Air-supplying fans 88 and 90 are connected to these air inlet ports 84 and 86, respectively, for supplying air into the chambers 56 and 58, respectively.

Figure 4:
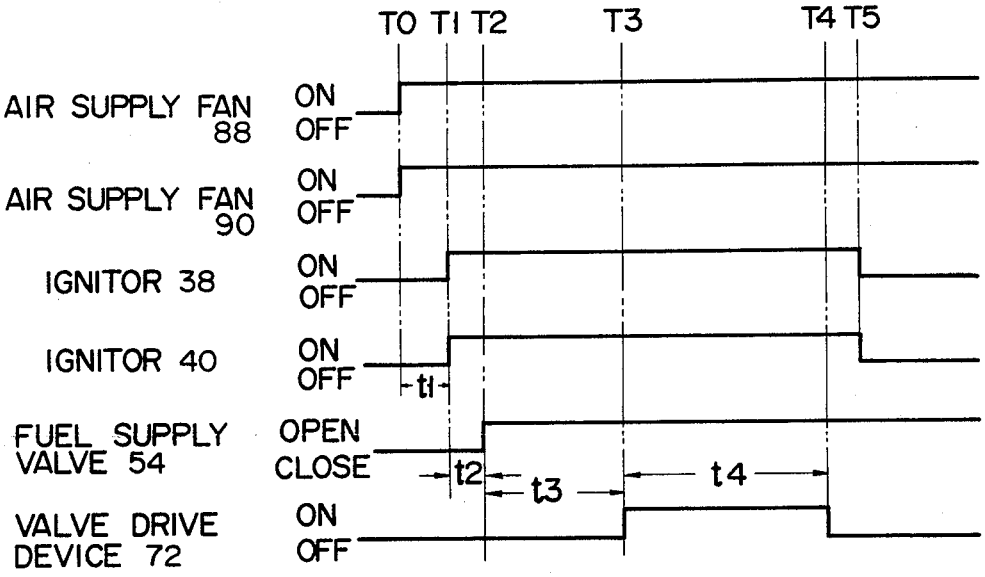
FIG. 4 is a timing chart, explaining how the components of the system operate during the starting period of the system.

As is illustrated in FIG. 1, a combustion control unit 92 is electrically connected to the ignitors 38 and 40, the fuel-supplying valve 54, and the air-supplying fans 88 and 90, to control these components in such a way as will be explained, with reference to FIGS. 4 and 5.

Before the pulsating combustion system is started, the disc 62 of the separation valve 60 completely partitions the air-intake chamber 12 into two chambers 56 and 58. When a start command $S_1$ is supplied to the combustion control unit 92 in this condition, the unit 92 supplies drive-start commands, $S_2$ and $S_3$ to air-supplying fans 88 and 90, respectively. In response to these commands $S_2$ and $S_3$, the fans 88 and 90 start at time $T_0$ (FIG. 4) and purge the residual gas out of the combustion chambers 26 and 28. Upon lapse of time $T_1$ from time $T_0$, that is, at time $T_1$ (FIG. 4), the combustion control unit 92 supplies start commands $S_4$ and $S_5$ to ignitors 38 and 40, respectively. Then, upon lapse of time $T_2$ from time $T_1$, that is at time $T_2$, the combustion control unit 92 supplies an open command S6 to the fuel-supplying valve 54.

In response to command S6, the fuel-supplying valve 54 opens, whereby the fuel gas flows into the air-intake pipes 42 and 44. As a result, the mixture gas, i.e., the mixture of the fuel gas and air, flows into both combustion chambers 26 and 28. The ignitors 38 and 40, which have been energized, ignite the mixture gas in the combustion chambers 26 and 28. The separation valve 60 is closed, at this time, but the chambers 26 and 28 communicate via the exhaust chamber 14 and interfere with each other. However, this interference is extremely weak, and the pulsating combustors 16 and 18 performs, in effect, pulsating combustion, independently of each other. The pulsating combustion which either combustor carrier out is sufficiently stable.

Upon elapse of a predetermined time $t_3$ from time $T_2$ when the pulsating combustion started in either combustion chamber, the combustion control unit 92 gives a drive command $S_7$ to the valve drive device 72. As a result of this, the separation valve 60 gradually opens. The opening of the valve 60 is increased exponentially, as is indicated in FIG. 5.

The opening of the valve 60 is small at first. The mutual interference of the pulsating combustors 16 and 18, which is achieved through the air-intake chamber 12 and both aerodynamic valves 46 and 48, is therefore not so prominent. Hence, even if the combustors 16 and 18 perform combustion in phase, they continue to perform the pulsating combustion. As the opening of the valve 60 increases, the interference between the combustors 16 and 18 increases proportionally. As a result, the pulsating combustions effected by the combustors 16 and 19 go gradually out of phase and become more and more stable. When the opening of the separation valve 60 further increases, the combustors 16 and 18 effects pulsating combustions which are completely out of phase.

Upon elapse of a predetermined time $t_4$ from time $T_3$, that is, at time $T_4$, the opening of the separation valve 60 reaches 100%. At time $T_4$, the combustion control unit 92 stops supplying the drive command S7 to the valve drive device 72. The opening of the valve 60 remains at 100%. A little later, at time $T_5$, both ignitors 38 and 40 are stopped. The pulsating combustions, which the combustors 16 and 18 are carrying out at this time ($T_5$), are completely out of phase, and the pulsating combustion system therefore performing a stable operation.

Figure 6A:
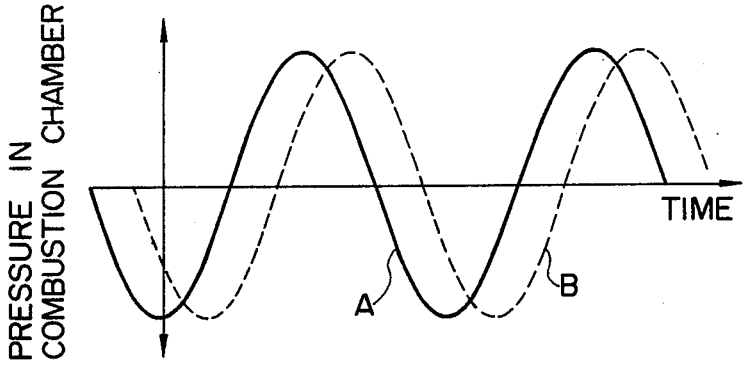
FIGS. 6A, 6B, and 6C are diagrams illustrating how the pressure within the combustion chambers change with the opening of the separation valve.
Figure 6B:
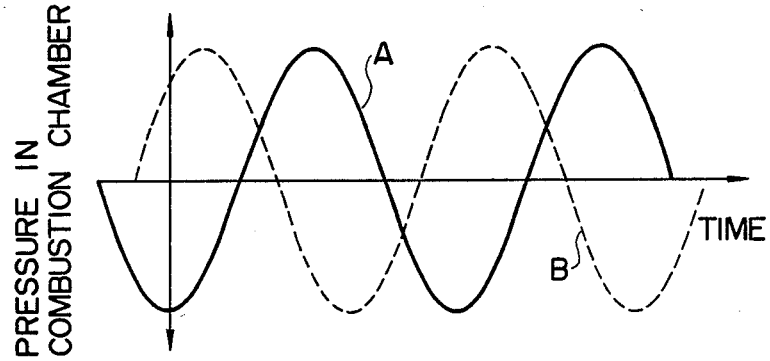
Figure 6C:
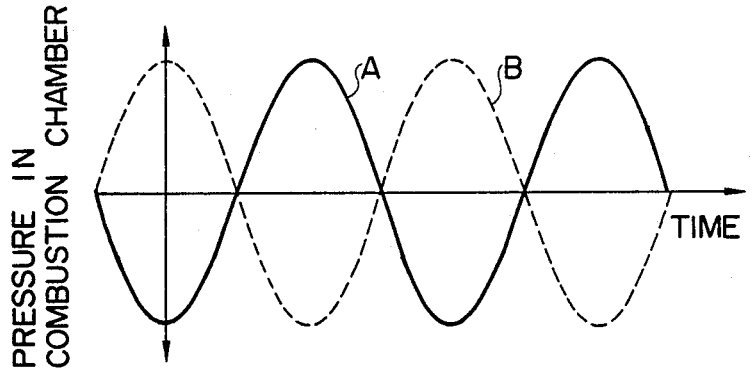

FIGS. 6A is a graph showing how the pressures within the combustion chambers change with time when the separation valve 60 is closed (i.e., the opening of the valve 60 is 0%), the curve A representing the pressure within the chamber 26, and the curve B indicating the pressure in the chamber 28. FIG. 6B is a graph explaining how the pressures within the combustion chambers change with time when the valve 60 is slightly open. Also in FIG. 6B, the curve A represents the pressure within the chamber 26; the curve B indicates the pressure in the chamber 28. FIG. 6C is a graph explaining how the pressures within the combustion chambers 26 and 28 change with time when the valve 60 is fully open (i.e., the opening of the valve 60 is 100%). Also in FIG. 6C, the curve A shows the pressure within the chamber 26, and the curve B represents the pressure in the chamber 28. As can be clearly understood from FIG. 6C, the pulsating combustions, taking place in the chambers 26 and 28 when the valve 60 is fully opens, are out of phase, perfectly by 180°, and the pulsating combustion system operates stably.

Figure 7:
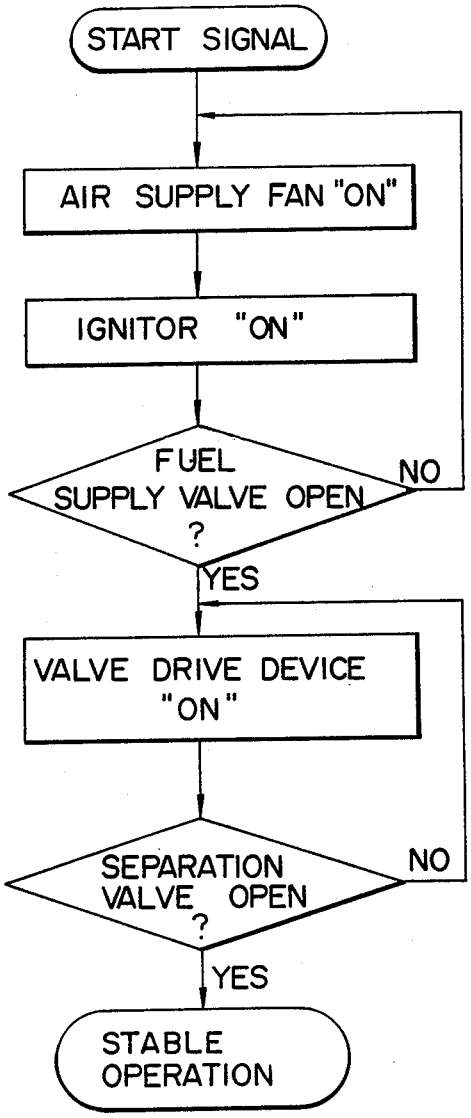
FIG. 7 is a flow chart explaining how the pulsating combustion system operates in response to a start command, until it assumes a stable operating condition.

FIG. 7 is a flow chart explaining the operations which the combustion control unit 92 carriers out, one after another, after it has received the start command $S_1$, whereby the pulsating combustion system operates stably.

Figure 8:
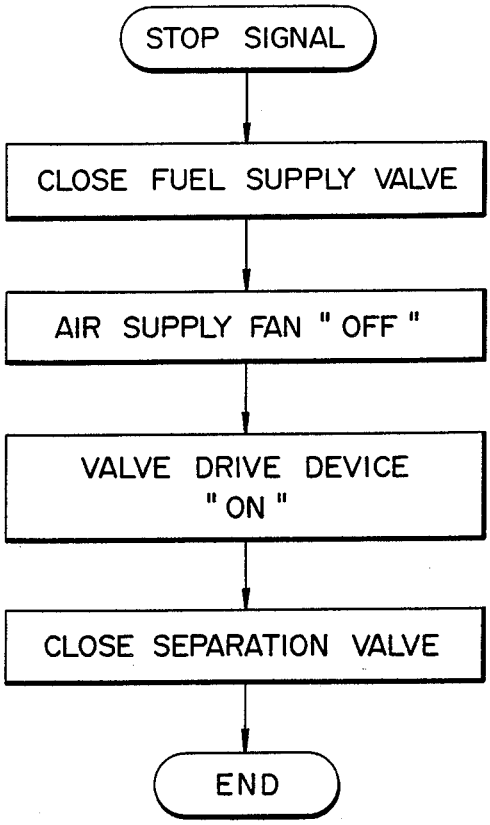
FIG. 8 is a flow chart explaining how the system stops performing a stable operation, in response to a stop command.

To stop the system performing the stable operation, it suffices to supply a stop command $S_9$ to the combustion control unit 92. When the command $S_9$ is supplied to the unit 92, the unit 92 controls various components, as is explained in the flow chart of FIG. 8. More specifically, in response to the stop command $S_9$, the unit 92 closes the fuel-supplying valve 54. Then, upon lapse of a predetermined time, the unit 92 turns off both air-supplying fans 88 and 90. Next, the unit 92 causes the valve drive device 72 to close the separation valve 60. As a result, the pulsating combustion system stops operating.

As has been described, the pulsating combustors 16 and 18 operate independently of each other during the starting period of the pulsating combustion system. When the pulsating combustion being performed by either combustor becomes stable, the separation valve 60 is gradually opened, allowing the combustors 16 and 18 to interfere increasingly with each other, through the air-intake chamber 12 and the air-intake pipes 42 and 44. When the valve 60 is fully opened, the pulsating combustions, when the combustors 16 and 18 are performing, are completely out of phase by 180°, whereby the pulsating combustion system operates stably. Hence, both combustors 16 and 18 can come to achieve out-of-phase combustions, smoothly within a short period of time after the system has been started.

Figure 3:
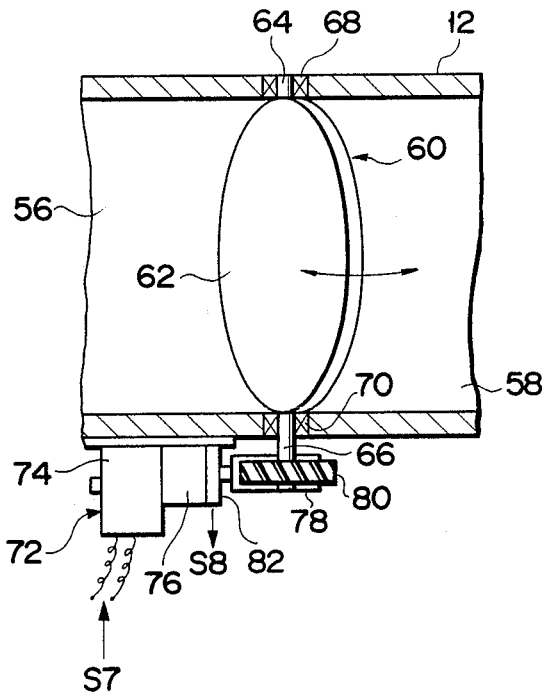
FIG. 3 is a sectional view illustrating the separation valve and some associated components - all incorporated in the system shown in FIG. 1.
Figure 9:
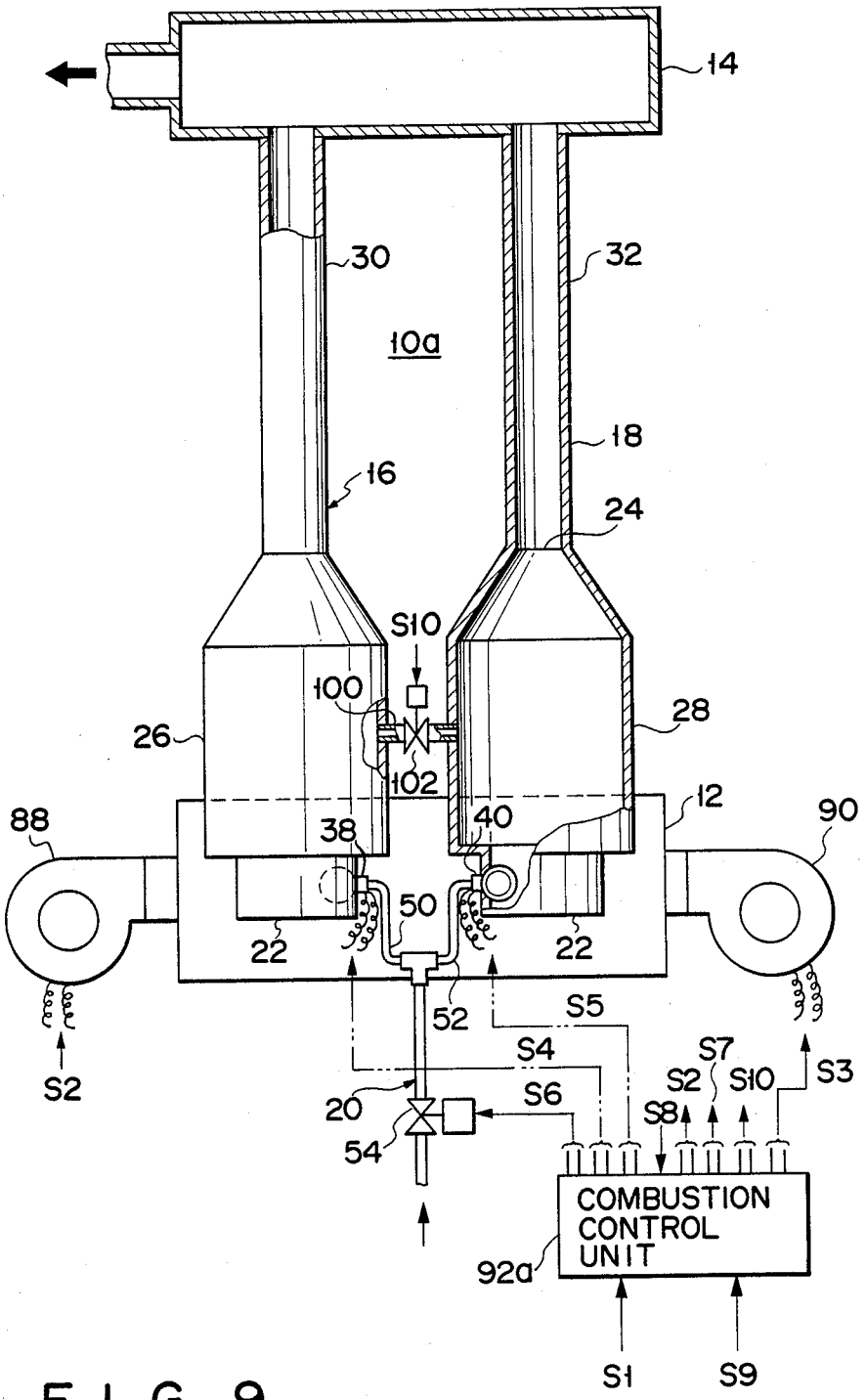
FIG. 9 is a partially sectional, front view shoring a pulsating combustion system according to another embodiment of the present invention.

FIG. 9 illustrates the main section **10*a* of another pulsating combustion system according to the present invention. The same components as those of the system shown in FIGS. 1, 2, and 3 are designated at the same numerals in FIG. 9**, and will not be described in detail.

The system shown in FIG. 9 is different in some respects. First, a thin interference pipe 100 connects the combustion chambers 26 and 28. Second, a valve 102 is located in the intermediate portion of the pipe 100, is opened by the combustion control unit **92*a* at the same time the separation valve 60 starts opening under the control of the unit 92*a*, and is closed when the valve is fully opened. The interference pipe 100, the valve 102, the unit 92*a* make it unnecessary to control the opening of the valve 60** minutely during the starting period of the pulsating combustion system.

Figure 10:
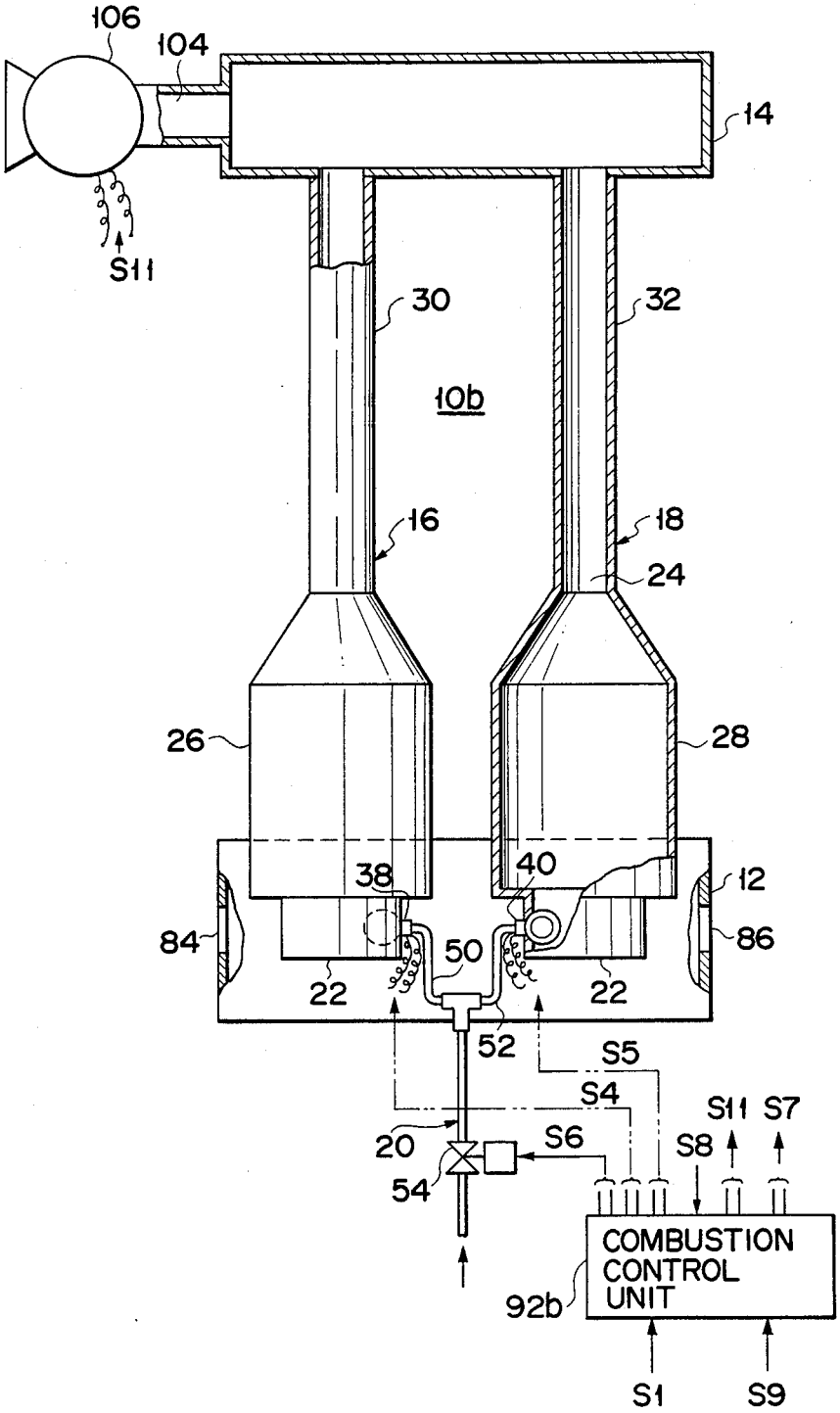
FIG. 10 is a partially sectional, front view illustrating a pulsating combustion system according to another embodiment of the present invention.

FIG. 10 illustrates the main section **10*b* of still another pulsating combustion system according to the present invention. The same components as those of the system in FIGS. 1, 2, and 3 are denoted at the same numerals in FIG. 9**, and will not, therefore, be descried in detail.

The system shown in FIG. 10 is different in some respects. First, a suction fan 106 is used in placed of the air-supplying fans 88 and 90. The fan 106 is connected to the exhaust port 104 of the exhaust chamber 14. When the fan 106 is driven, thus discharging the combustion gas from the chamber 14, the pressures in both combustion chambers 26 and 28 are reduced. As a result, air flows into the air-intake chamber 12 through the air inlet ports 84 and 86. The fan 106 is controlled by the combustion control unit **92*b*, in exactly the same way as the fans 88 and 90 are controlled in the first embodiment illustrated in FIGS. 1, 2, and 3. The system shown in FIG. 10** can be manufactured at lower cost than the first embodiment since it requires only one fan.

Figure 11:
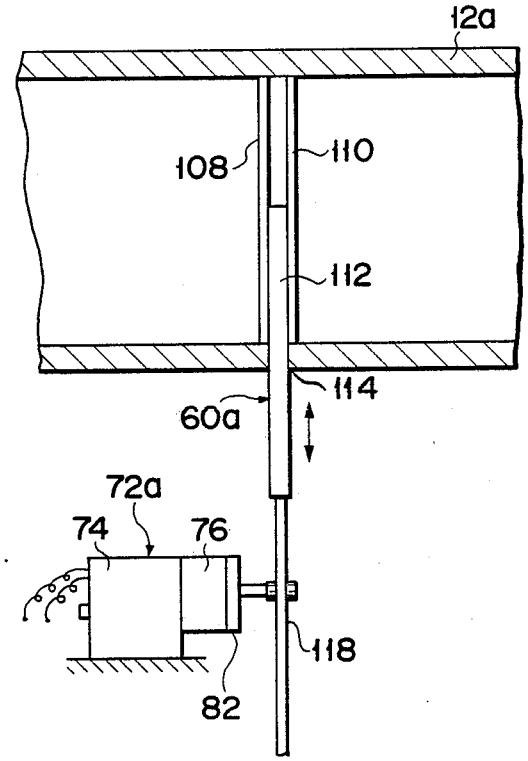
FIG. 11 is a cross-sectional view showing a modification of the separation valve.

The separation valve 60 of any embodiment described above is a throttle valve. Nonetheless, the valve 60 is not limited to a throttle valve, in accordance to the present invention. For instance, a sluice valve **60*a* of the type shown in FIG. 11 can be used. As is shown in FIG. 11, this valve 60*a* comprises two guides 108 and 110, both provided within the air-intake chamber 12*a*, and a valve plate 112 is linearly moved into and out of the chamber 12*a*, passing through a slit 114 out in the chamber 12*a* while being guided by the guided 108 and 110. In this case, the chamber 12*a* is a hollow prism having a rectangular cross section. The valve plate 114 is connected to a pinion-lack mechanism 118, which is in turn coupled to the reduction gear 76**.

Figure 5:
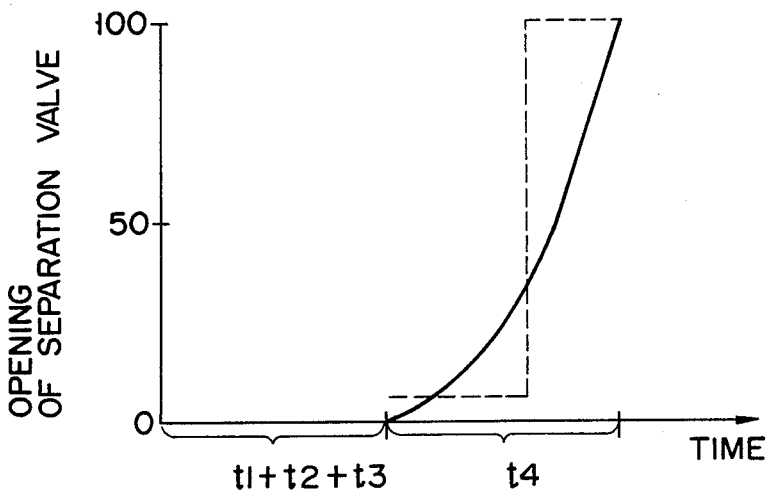
FIG. 5 is a graph representing how the opening of the separation valve changes with time during the starting period of the pulsating combustion system.

Moreover, the opening of the separation valve 60 can be increased not only exponentially, but also stepwise as is indicated by the broken line in FIG. 5.

Other changes and modifications can be made, without departing the spirit of the present invention.

What is claimed is:

1. A pulsating combustion system comprising:

a pair of pulsating combustors identical in structure, each comprising a combustion chamber having an air-intake port and an exhaust port, and further comprising at least two air-intake pipes each connected at one end to one of the air-intake ports, at least two tail pipes each connected at one end to one of the exhaust ports, at least two aerodynamic valves each fitted within one of said air-intake pipes and having a forward flow coefficient and a backward flow coefficient smaller then the forward flow coefficient, fuel-injecting means for injecting fuel into each of the combustion chambers, and ignition means located within each of the combustion chambers;

an air-intake chamber to which the air-intake pipes of said pulsating conductors are connected at the other end;

an exhaust chamber to which the tail pipes of said pulsating combustors are connected at the other end;

air-supplying means for causing air to flow from said air-intake chamber to said exhaust chamber through said pulsating combustors;

separation valve means located within said air-intake chamber, for partitioning said air-intake chamber into a first sub-chamber communicating with said air supply means and with the air-intake pipe of one of said pulsating combustors and a second sub-chamber communicating with said air supply means and with the air-intake pipe of the other pulsating combustor; and means for opening said separation valve means, thereby connecting said pulsating combustors, after said pulsating combustors have operated independently of each other for some time, with said air-intake chamber separated into said two sub-chambers by means of said separation valve means.

2. A system according to claim 1, wherein said separation valve means comprises a valve plate of throttle-valve type rotatably located within said air-intake chamber, and drive means located outside said air-intake chamber for rotating the valve plate.

3. A system according to claim 1, wherein said separation valve means comprises a valve plate of sluice-valve type slidably inserted in said air-intake chamber through a slit made in the wall of said air-intake chamber, and drive means located outside said air-intake chamber for sliding the valve into and out of said air-intake chamber.

4. A system according to claim 1, wherein said air-supplying means comprises a pair of fans for supplying air into the sub-chambers defined in said air-intake chamber by means of said separation valve means.

5. A system according to claim 1, wherein said air-supplying means comprises one fan connected to a downstream end of said exhaust chamber, for exhausting air from said exhaust chamber.

6. A system according to claim 1, further comprising a thin interference pipe connecting the combustion chambers of said pulsating combustors, said interference pipe having means for causing the pressures in said combustion chambers to interfere with each other as long as said air-intake chamber is separated into two sub-chambers by means of said separation valve means.

7. A method of starting a pulsating combustion system comprising a pair of pulsating combustors identical in structure and connected in parallel by a common air-intake chamber and a common exhaust chamber, each of said pulsating combustors having an air intake pipe communicating with said common air-intake chamber, each of said air-intake pipes having an aerodynamic valve fitted therein, said aerodynamic valves having a forward flow coefficient and a backward flow coefficient smaller than the forward flow coefficient, said method comprising the steps of:

separating the air-intake ports of said pulsating combustors from each other in said common air intake chamber, thereby causing said pulsating combustors to operate independently;

supplying air and fuel into each of said pulsating combustors, thus causing said pulsating combustors to start pulsating combustion independently of each other; and connecting the air-intake ports of said pulsating combustors gradually through said common air-intake chamber, thus connecting said pulsating combustors in parallel, when the pulsating combustion performed by either pulsating combustor becomes sufficiently stable.

* * * * *